US007606514B2

(12) United States Patent
Sakai

(10) Patent No.: US 7,606,514 B2
(45) Date of Patent: Oct. 20, 2009

(54) BELT DRIVING APPARATUS, IMAGE FORMING APPARATUS, BELT DRIVING METHOD, AND COMPUTER-READABLE MEDIUM FOR DRIVING A BELT

(75) Inventor: Yoshihiro Sakai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 476 days.

(21) Appl. No.: 11/440,048

(22) Filed: May 25, 2006

(65) Prior Publication Data

US 2006/0280523 A1 Dec. 14, 2006

(30) Foreign Application Priority Data

May 27, 2005 (JP) ..... 2005-156227
May 2, 2006 (JP) ..... 2006-128559

(51) Int. Cl.
*G03G 15/00* (2006.01)

(52) U.S. Cl. ..... 399/167; 198/810.03; 318/567; 399/301

(58) Field of Classification Search ..... 399/167, 399/162, 301, 394, 396; 198/810.01, 810.03; 318/567
See application file for complete search history.

(56) References Cited

U.S. PATENT DOCUMENTS 5,545,381 A 8/1996 Iida et al. ..... 422/186
5,612,766 A 3/1997 Iida et al. ..... 399/23
RE37,197 E 5/2001 Iida et al. ..... 422/186
2004/0197111 A1* 10/2004 Kuroda ..... 399/66
2005/0099153 A1 5/2005 Komatsu et al. ..... 318/807
2005/0129427 A1* 6/2005 Kinoshita et al. ..... 399/167
2006/0133861 A1* 6/2006 Sakai ..... 399/301

FOREIGN PATENT DOCUMENTS

JP 2004-191845 7/2004
JP 2004-198624 7/2004
JP 2005-092763 4/2005
JP 2006-128559 5/2006

OTHER PUBLICATIONS

European Search Report for Corresponding European Application No. 06010632.5.

* cited by examiner

*Primary Examiner*—Sophia S Chen
(74) *Attorney, Agent, or Firm*—Harness, Dickey & Pierce, P.L.C.

(57) ABSTRACT

A belt driving apparatus is disclosed, that uses feedback signals for executing feedback control of a motor that drives the rotation of a belt. The belt driving apparatus includes a first sensor for detecting an index of a scale formed along a peripheral direction of the belt, a second sensor for detecting a detection target cooperatively moving with the rotation of the belt, and a sensor switching part for selectively switching the feedback signals used for executing the feedback control of the motor. The feedback signals include first signals output from the first sensor and second signals output from the second sensor. The sensor switching part selects the first or second signals accordingly.

17 Claims, 12 Drawing Sheets

Conventional Art

Prior Art

BELT DRIVING APPARATUS, IMAGE FORMING APPARATUS, BELT DRIVING METHOD, AND COMPUTER-READABLE MEDIUM FOR DRIVING A BELT

BACKGROUND OF THE INVENTION

1. Field of the Invention

The present invention relates to a belt driving apparatus, an image forming apparatus, a belt driving method, and a computer-readable medium, and more particularly to a belt driving apparatus using feedback signals for executing feedback control of a motor that drives the rotation of a belt, an image forming apparatus including the belt driving apparatus, a method for driving the belt, and a computer-readable medium on which a program is recorded for causing a computer to execute the belt driving method.

2. Description of the Related Art

In a conventional belt driving apparatus for driving, for example, an intermediary transfer belt of an image forming apparatus, a scale including plural indexes (e.g. adhesive marks) arranged in predetermined intervals along a peripheral direction of the belt is adhered onto a side edge part of the surface of the belt. The belt driving apparatus detects each index of the scale by using a sensor (reflection type photo sensor). Then, the belt driving apparatus detects the velocity of the belt based on the pulses output from the sensor in accordance with the detected indexes. Then, in accordance with the detected velocity of the belt, the belt driving apparatus controls a belt driving motor that drives the belt (feedback control). The feedback control enables the intermediary transfer belt to be driven at a desired velocity (uniform velocity).

Accordingly, the feedback control can prevent the velocity of the sheet conveyor belt or an intermediary transfer belt from changing and also prevent the positions of color images from deviating in a case where the belt is used, for example, in a color image forming apparatus (e.g. tandem type image forming apparatus) including plural photoconductors 91Y, 91C, 91M, and 91K (see FIGS. 10 and 11).

However, even where the scale is formed having indexes disposed at predetermined intervals along the peripheral direction of the intermediary transfer belt, factors such as anomaly in the length of the intermediary transfer belt may cause formation of a seam part between the starting end and the terminating end of the scale. Accordingly, in a case where the sensor detects the seam, the detection pulse corresponding to the detected seam (See FIG. 12) will have a longer pulse width compared to the pulse width of a detection pulse corresponding to a part other than the detected seam (See FIG. 13).

In a case where feedback control is performed using the detection pulse with a long pulse width, a control unit detecting the detection pulse with the long pulse width will determine that the belt velocity has decreased even though the actual belt velocity has not decreased. As a result, the belt driving apparatus will execute a feedback control process for increasing the velocity of the belt. This may lead to problems such as abnormal activation of the motor.

In order to solve this problem, Japanese Laid-Open Patent Application No. 2004-191845 discloses an image forming apparatus including a belt driving apparatus having an initial mark detecting sensor for detecting an initial mark provided on an endless belt so that the initial mark may be detected prior to reading marks provided on a scale of the endless belt. In a case where the initial mark is detected, the control by a first velocity controlling apparatus including a first scale sensor is cancelled and the control by a second velocity controlling apparatus including a second scale sensor is activated. Accordingly, the velocity of the endless belt is controlled by the second velocity controlling apparatus.

As another example, Japanese Laid-Open Patent Application No. 2004-198624 discloses an apparatus which detects changes of signals output from a sensor that detects the scale of an intermediary transfer belt. In a case where there is no change in the signals of the sensor, the apparatus determines that a seam of the scale is being detected and continues to drive the intermediary transfer belt at the same speed as the speed prior to the detection of the seam.

However, the image forming apparatus disclosed in Japanese Laid-Open Patent Application No. 2004-191845 requires having the initial mark and the initial mark detecting sensor in addition to the first and second velocity controlling apparatuses. Furthermore, in order to increase the velocity of the belt driving motor to a predetermined velocity upon activation of the belt driving motor, the image forming apparatus requires complicated controls for increasing the velocity of the belt driving motor to the predetermined velocity while considering load characteristics of the motor. However, in a case where the initial mark is detected in the middle of increasing the velocity of the belt driving motor, the feedback signals (sensor signals) will change abruptly when control is switched from the first velocity controlling apparatus to the second velocity controlling apparatus in response to the detection of the initial mark. This is due to the phase difference between the signals output from the first sensor and the signals output from the second sensor. Since motors, in general, require a large amount of torque in a period between activation of the motor and reaching a predetermined driving speed, the motor is unable to respond to abrupt changes of feedback signals (sensor signals) during such periods. As a result, the motor may experience various malfunctions (e.g. out of step of the motor, discontinuation of the motor).

In the image forming apparatus disclosed in Japanese Laid-Open Patent Application No. 2004-198624, controlling the velocity to be constant upon detection of the seam is not desirable during the period between activation of the motor and reaching a predetermined driving velocity. That is, even in a case when the seam of the scale is detected, it is desired to increase the velocity of the belt driving motor to the predetermined velocity without experiencing any malfunctions of the motor (e.g. out of step of the motor, discontinuation of the motor) during the period between activation of the motor and reaching the predetermined driving velocity.

SUMMARY OF THE INVENTION

The present invention may provide a belt driving apparatus, an image forming apparatus, a belt driving method, and a computer-readable medium that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a belt driving apparatus, an image forming apparatus, a belt driving method, and a computer-readable medium particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a belt driving apparatus using feedback signals for executing feedback control of a motor that drives the rotation of a belt, the belt driving apparatus including: a first sensor for detecting an index of a scale formed along a peripheral direction of the belt; a second sensor for detecting a detection target cooperatively moving with the rotation of the belt; and a sensor switching part for selectively switching the feedback signals used for executing the feedback control of the motor, the feedback signals including first signals output from the first sensor and second signals output from the second sensor; wherein the sensor switching part selects the second signals as the feedback signals to be used during a period beginning at the activation of the motor and ending when a predetermined condition is satisfied, wherein the sensor switching part selects the first signals as the feedback signals to be used after the predetermined condition is satisfied.

In the belt driving apparatus according to an embodiment of the present invention, the sensor switching part may switch the use of the feedback signals from the second signals to the first signals when a predetermined time elapses.

In the belt driving apparatus according to an embodiment of the present invention, the predetermined time may be a time required for the rotational velocity of the belt to reach a predetermined velocity.

In the belt driving apparatus according to an embodiment of the present invention, the sensor switching part may switch the feedback signals being used from the second signals to the first signals when the sensor switching part detects that the rotational velocity of the belt has reached the predetermined speed.

In the belt driving apparatus according to an embodiment of the present invention, the motor may include a rotary axle to which an encoder is attached, wherein the encoder includes a disk, and wherein the detection target is an index formed on the disk.

In the belt driving apparatus according to an embodiment of the present invention, the belt driving apparatus may further include a driving roller that rotates the belt, wherein the driving roller includes a rotary axle to which an encoder is attached, wherein the encoder includes a disk, and wherein the detection target is an index formed on the disk.

In the belt driving apparatus according to an embodiment of the present invention, the belt driving apparatus may further include a driven roller that is rotatively driven by the rotation of the belt, wherein the driven roller includes a rotary axle to which an encoder is attached, wherein the encoder includes a disk, and wherein the detection target is an index formed on the disk.

In the belt driving apparatus according to an embodiment of the present invention, the predetermined time may be set in accordance with the load applied to the motor.

In the belt driving apparatus according to an embodiment of the present invention, the second signals may be used as the feedback signals even after the predetermined condition is satisfied when the first signals are abnormal.

Furthermore, the present invention provides an image forming apparatus including: a motor for driving the rotation of a belt; a controller for executing feedback control of the motor by using feedback signals; a first sensor for detecting an index of a scale formed along a peripheral direction of the belt; a second sensor for detecting a detection target cooperatively moving with the rotation of the belt; and a sensor switching part for selectively switching the feedback signals used for executing the feedback control of the motor, the feedback signals including first signals output from the first sensor and second signals output from the second sensor; wherein the sensor switching part selects the second signals as the feedback signals to be used during a period beginning at the activation of the motor and ending when a predetermined condition is satisfied, wherein the sensor switching part selects the first signals as the feedback signals to be used after the predetermined condition is satisfied.

In the image forming apparatus according to an embodiment of the present invention, the sensor switching part may switch the feedback signals being used from the second signals to the first signals when a predetermined time elapses.

In the image forming apparatus according to an embodiment of the present invention, the predetermined time may be a time required for the rotational velocity of the belt to reach a predetermined velocity.

In the image forming apparatus according to an embodiment of the present invention, the sensor switching part may switch the feedback signals being used from the second signals to the first signals when the sensor switching part detects that the rotary velocity of the belt has reached the predetermined speed.

In the image forming apparatus according to an embodiment of the present invention, the predetermined time may be a time within a period starting at the activation of the motor and ending when an image forming operation begins.

In the image forming apparatus according to an embodiment of the present invention, the belt may include one or more of a photoconductor belt, a transfer belt, an intermediary transfer belt, and an image recording medium conveying belt.

Furthermore, the present invention provides a belt driving method for executing feedback control of a motor that drives the rotation of a belt, the method comprising the steps of: executing the feedback control according to first signals output from a first sensor that detects an index of a scale formed along a peripheral direction of the belt after a predetermined condition is satisfied; and executing the feedback control according to second signals output from a second sensor that detects a detection target cooperatively moving with the rotation of the belt during a period beginning at the activation of the motor and ending when the predetermined condition is satisfied.

Furthermore, the present invention provides a computer-readable medium on which a program is recorded for causing a computer to execute a belt driving method for executing feedback control of a motor that drives the rotation of a belt, the belt driving method including the steps of: executing the feedback control according to first signals output from a first sensor that detects an index of a scale formed along a peripheral direction of the belt after a predetermined condition is satisfied; and executing the feedback control according to second signals output from a second sensor that detects a detection target cooperatively moving with the rotation of the belt during a period beginning at the activation of the motor and ending when the predetermined condition is satisfied.

Other objects and further features of the present invention will be apparent from the following detailed description when read in conjunction with the accompanying drawings.

DESCRIPTION OF THE PREFERRED EMBODIMENTS

In the following, embodiments of the present invention are described with reference to the accompanying drawings.

Figure 1:
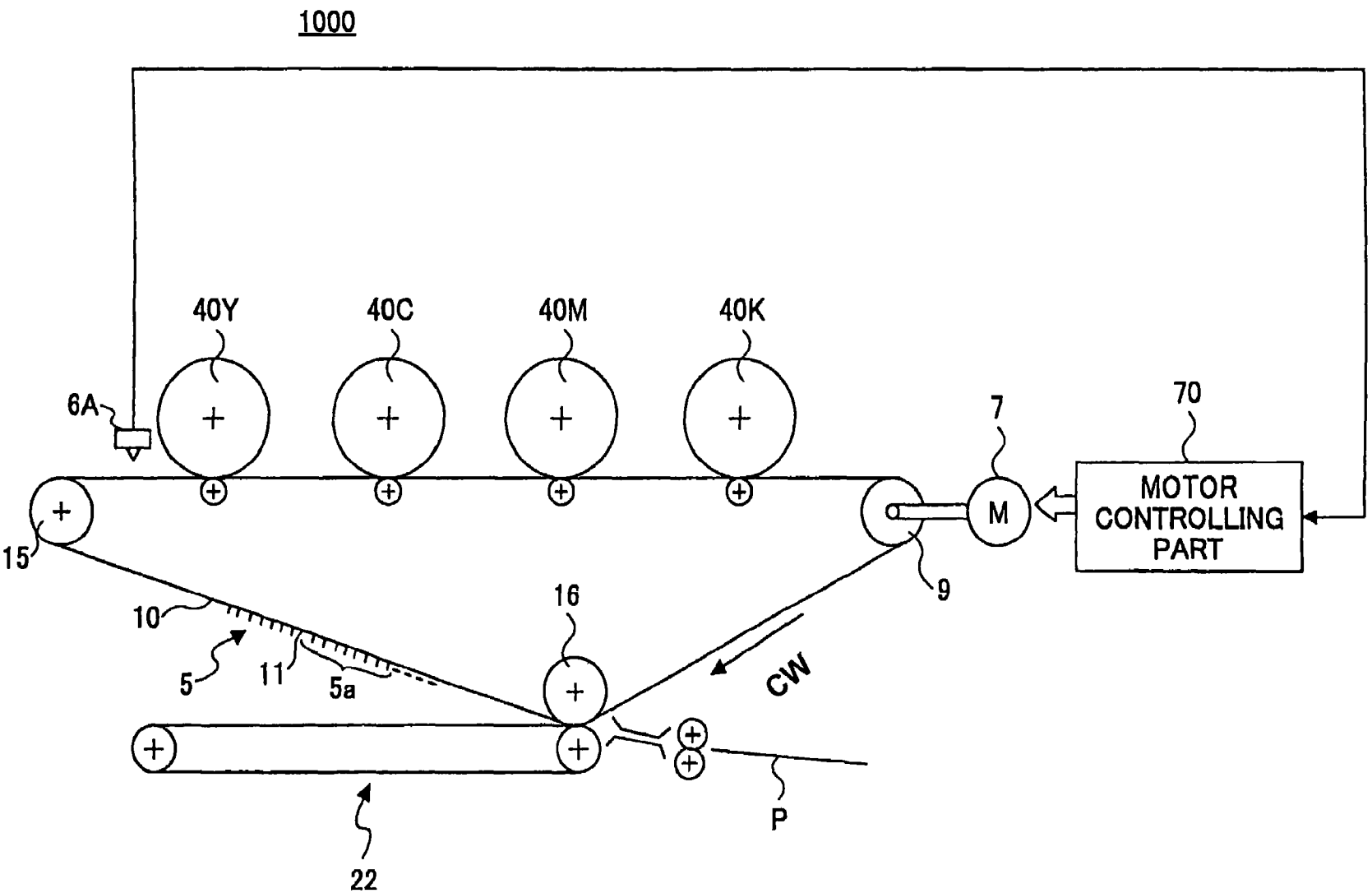
FIG. 1 is a schematic view showing a belt driving apparatus 1000 included in an image forming apparatus 2000 according to an embodiment of the present invention.
Figure 2:
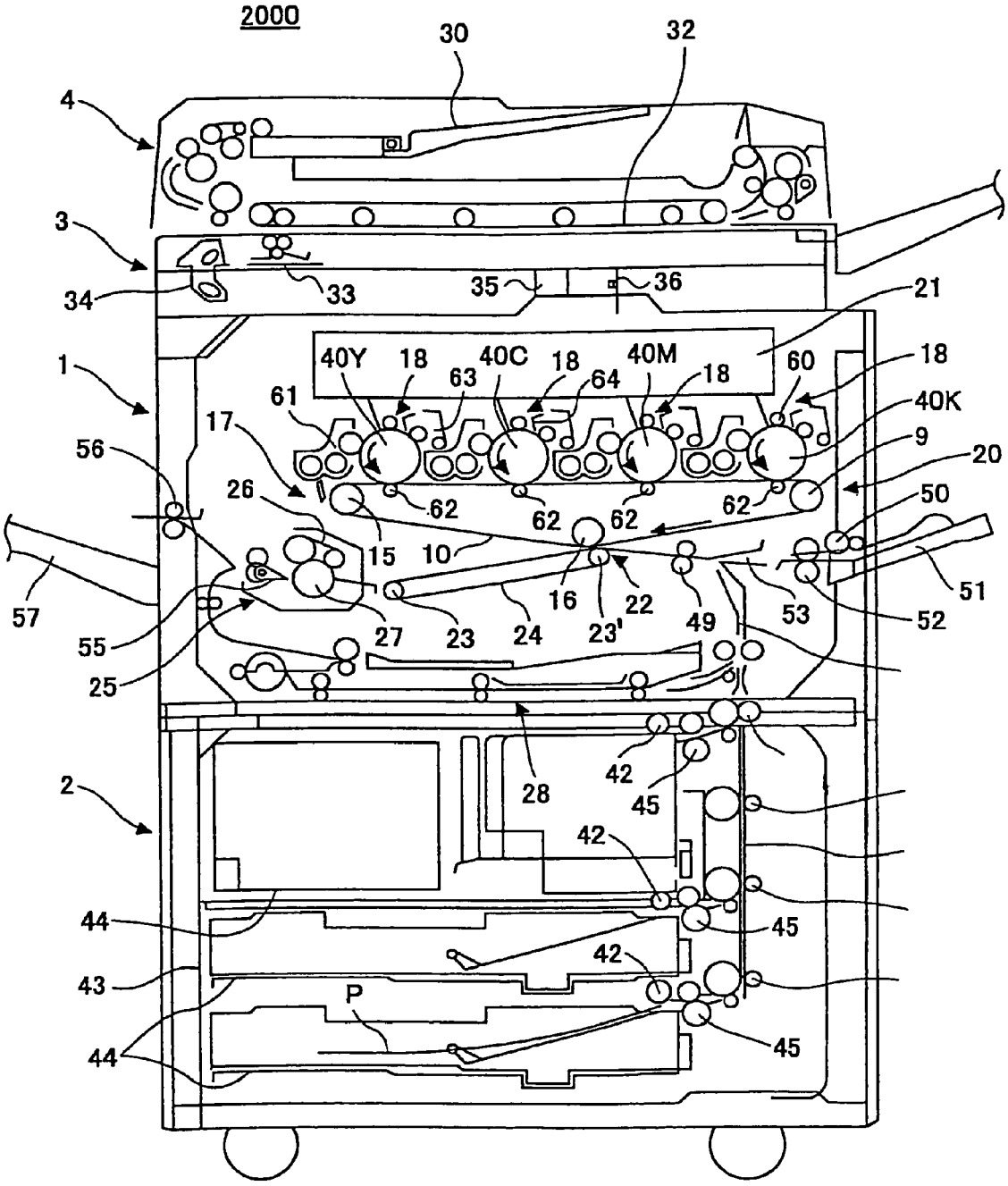
FIG. 2 is a schematic view showing an example of an overall configuration of the image forming apparatus 2000 according to an embodiment of the present invention.
Figure 3:
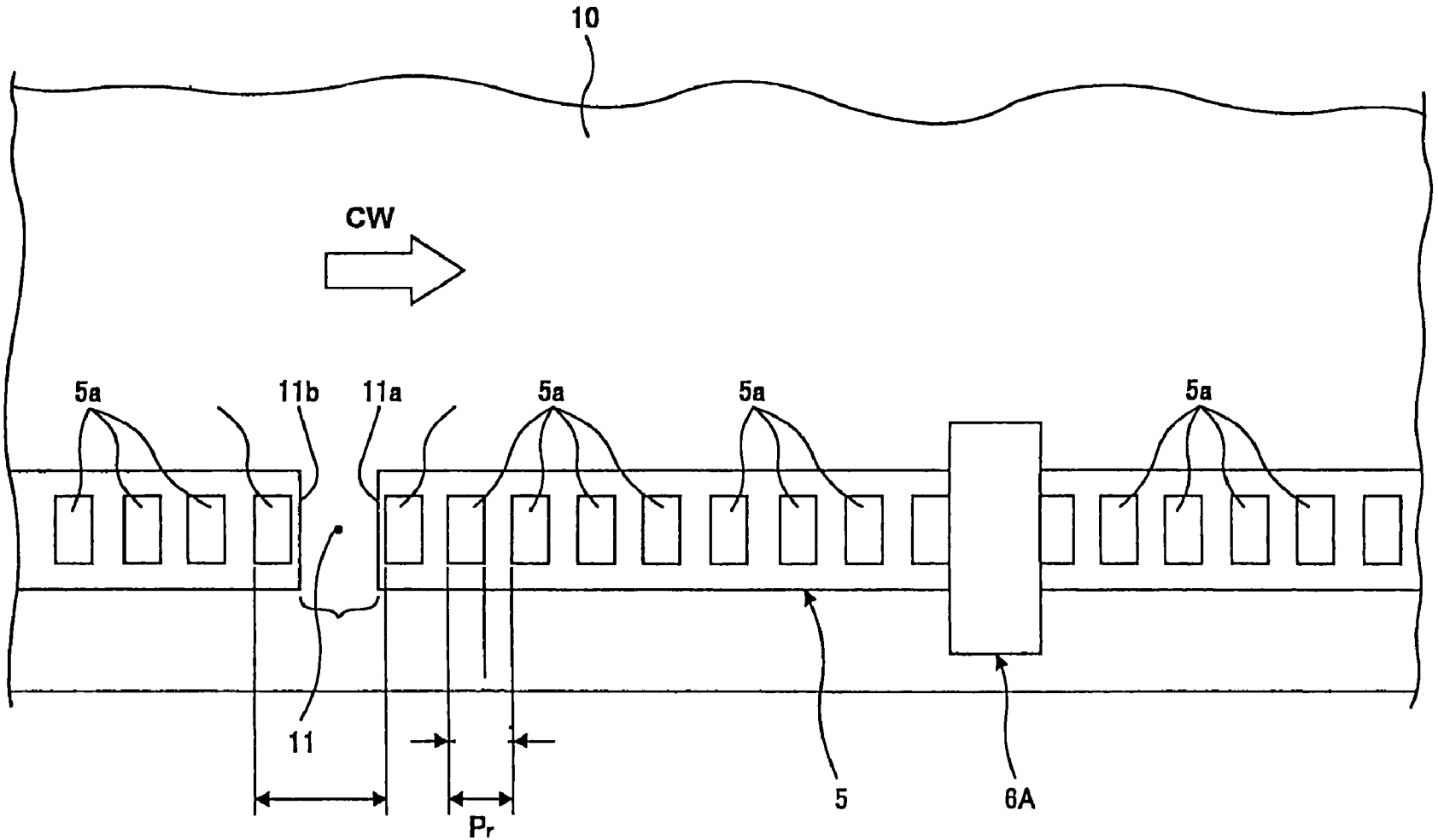
FIG. 3 is a plan view showing a scale 5 having indexes 5*a* provided on an intermediary transfer belt 10 of the belt driving apparatus 1000 and a first sensor 6A for detecting the indexes 5*a* according to an embodiment of the present invention.

FIG. 1 is a schematic view showing a belt driving apparatus 1000 included in an image forming apparatus 2000 according to an embodiment of the present invention. FIG. 2 is a schematic view showing an example of an overall configuration of the image forming apparatus 2000. FIG. 3 is a plan view of a scale 5 having indexes 5*a* provided on an intermediary transfer belt 10 of the belt driving apparatus 1000 and a first sensor 6A for detecting the indexes 5*a*.

The image forming apparatus 2000 shown in FIG. 2 is a tandem type image forming apparatus including, for example, four drum-shaped photoconductors 40Y, 40C, 40M, and 40K corresponding to the colors of Yellow (Y), Cyan (C), Magenta (M), and Black (K) (hereinafter simply referred to as a photoconductor 40 unless otherwise described) and an intermediary transfer belt 10 for transferring the images formed on the photoconductors 40 to corresponding first transferring positions at which roller-shaped first transferring apparatuses 62 are provided.

In the belt driving apparatus 1000 of the image forming apparatus 2000, a scale 5 having plural indexes (e.g. marks) 5*a* is formed on the surface (front surface) of the intermediary transfer belt 10 (see FIG. 3). The indexes 5*a* are arranged in a peripheral direction of the intermediary transfer belt 10. The scale 5 according to an embodiment is formed substantially entirely around the intermediary transfer belt 10 in the peripheral direction of the intermediary transfer belt 10 (the scale 5 having the plural indexes 5*a* is illustrated only at a portion of the intermediary transfer belt 10 in FIG. 1 for the sake of simplifying the drawing). In this example, the scale 5 is adhesively bonded to the intermediary transfer belt 10. A seam 11 is formed between a starting end (front end) and a terminating end (rear end) of the scale 5. It is to be noted that the scale 5 provided on the intermediary transfer belt 10 is also referred to as an adhesive scale seal.

The first sensor 6A detects the indexes 5*a* of the scale 5 and outputs detection signals to a motor control apparatus (controlling part) 70 shown in FIG. 1. The detection signals output from the first sensor 6A have an output value corresponding to the detection results of the first sensor 6A. The motor control apparatus 70 controls (feedback controls) the velocity of the intermediary transfer belt 10 based on the output value of the detection signals from the first sensor 6A so that the intermediary transfer belt 10 is driven at a uniform velocity (constant velocity).

In performing the feedback control, the actual velocity of the intermediary transfer belt 10 is calculated by reading (detecting) the indexes 5*a* of the scale 5 and adjusting (correcting) the velocity of the intermediary transfer belt 10 (hereinafter also simply referred as "belt velocity") to be a predetermined velocity (target velocity) in accordance with the calculated actual velocity of the intermediary transfer belt 10.

Furthermore, in performing the feedback control, a second sensor 6B (See FIG. 4) is used in addition to using the first sensor 6A. The first sensor 6A according to an embodiment of the present invention is for detecting (reading) the index(es) 5*a* of the scale 5. The second sensor 6B according to an embodiment of the present invention is for optically detecting (reading) an index(es) formed on a rotary disk 81 of an encoder 80. The second sensor 6B according to an embodiment of the present invention is attached to a driving roller 9 of the belt driving apparatus 1000.

It is to be noted that the scale 5 may alternatively be formed on the rear surface of the intermediary transfer belt 10. Furthermore, although the indexes 5*a* of the scale 5 are provided as marks on the surface of the intermediary transfer belt 10, the indexes 5*a* may alternatively be provided by forming, for example, plural slits or transparent circles on the surface of the intermediary transfer belt 10. In such a case, the first sensor 6A is to be fabricated in accordance with the configuration of the index 5*a*. For example, in a case where the indexes 5*a* are provided in the form of marks on the surface of the intermediary transfer belt 10, the first sensor 6A may be a light reflecting type sensor. In a case where the indexes 5*a* are provided as slits or transparent circles on the surface of the intermediary transfer belt 10, the first sensor 6A may be a transparent type sensor.

Figure 4:
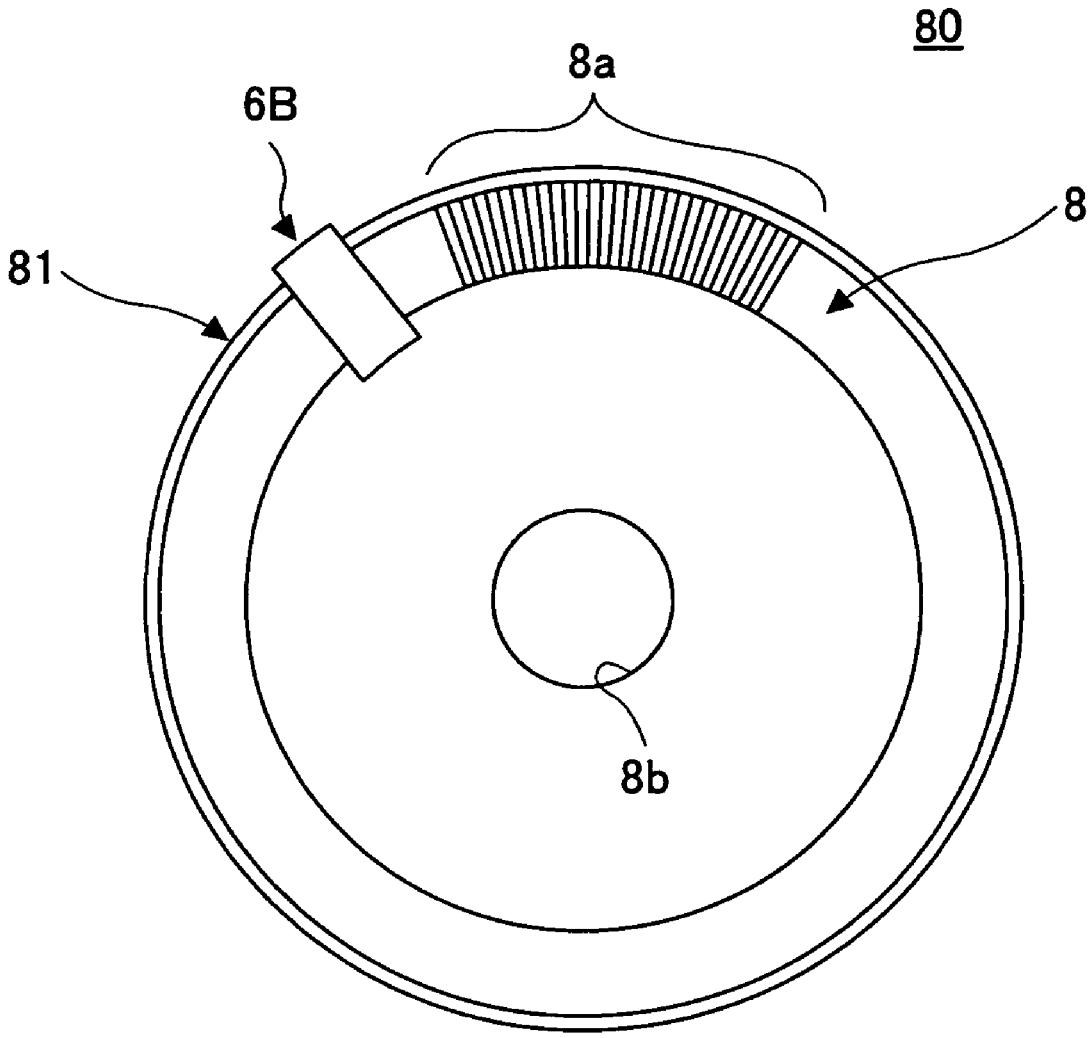
FIG. 4 is a schematic diagram showing an exemplary configuration of a rotary disk included in an encoder that is attached to the driving roller 9 according to an embodiment of the present invention.

FIG. 4 is a schematic diagram showing an exemplary configuration of a rotary disk included in an encoder that is attached to the driving roller 9.

The rotary disk 81 has plural indexes 8*a* written onto a scale 8 provided on the surface of the rotary disk 81 in a manner encircling the rotary disk 81 along its periphery (the scale 8 having the plural indexes 8*a* is illustrated only at a portion of the periphery of the rotary disk 81 in FIG. 4 for the sake of simplifying the drawing). The indexes 8*a* in this embodiment serve as detection targets that cooperatively move in accordance with the rotation of the intermediary transfer belt 10. In this example, the scale 8 is adhesively bonded to the rotary disk 81. The second sensor 6B detects the indexes 8*a* of the scale 8 and outputs detection signals to the motor control apparatus (controlling part) 70 shown in FIG. 1. The detection signals output from the second sensor 6B have an output value corresponding to the detection results of the second sensor 6B. The second sensor 6B may have substantially the same configuration as the first sensor 6A. Furthermore, the rotary disk 81 is formed having an insertion hole 8*b* into which the rotary axle of the driving roller 9 is inserted.

It is to be noted that the rotary disk 81 (encoder 80) illustrated in FIG. 4 is not limited to being attached to the driving roller 9. For example, the encoder 80 (or its rotary disk 81) may alternatively be attached to the rotary axle of a belt driving motor 7 included in the belt driving apparatus 1000. In another example, the encoder 80 (or its rotary disk 81) may alternatively be attached to the rotary axle of another roller (e.g. driven roller 15 or 16 shown in FIG. 1) that cooperatively moves with the drive (rotation) of the intermediary transfer belt 10.

Figure 5:
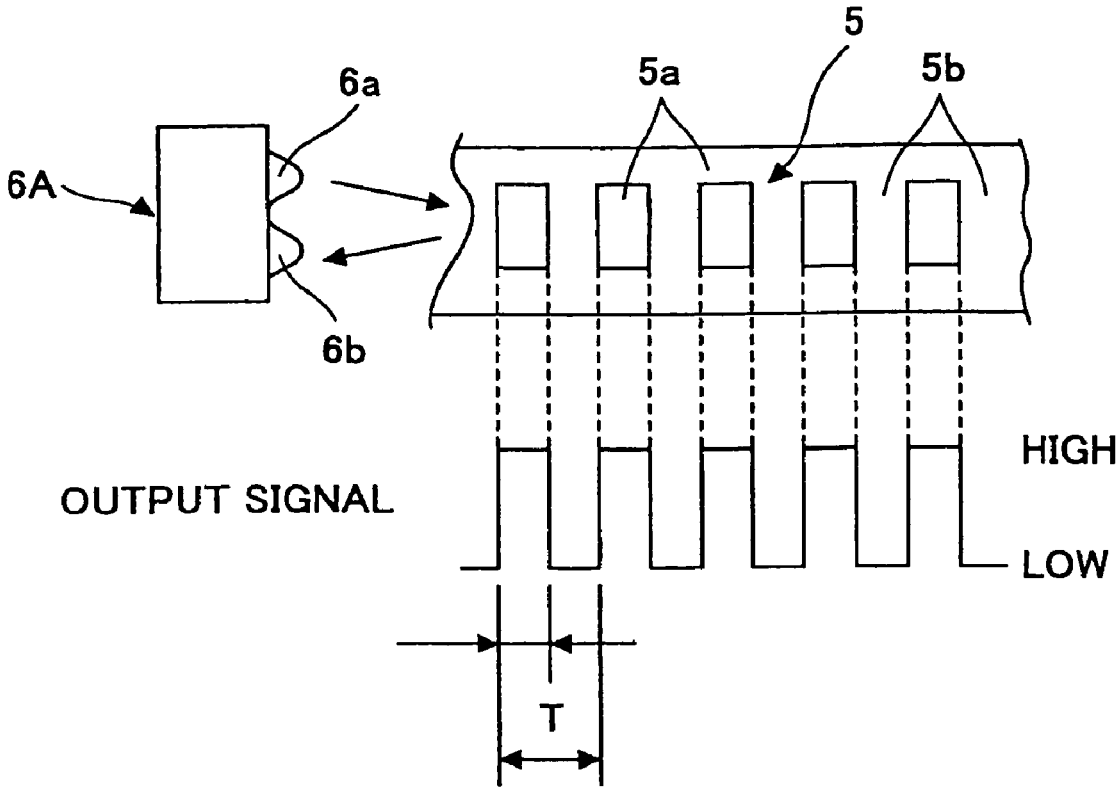
FIG. 5 is a schematic diagram for describing an exemplary configuration and operation of the first sensor 6A that detects indexes 5*a* of a scale 5 and outputs binary signals according to an embodiment of the present invention.

FIG. 5 is a schematic diagram for describing an exemplary configuration and operation of the first sensor 6A. In the example shown in FIG. 5, the first sensor 6A is a reflection type optical sensor having a combination of a light emitting element 6*a* and a light receiving element 6*b*. In the first sensor 6A illustrated in FIG. 5, the light emitting element 6*a* emits light in the direction of the scale 5. The light reflected from the scale 5 is received by the light receiving element 6*b*. The first sensor 6A detects the reflected light, in which the amount of light differs depending on which part of the scale 5 the light is reflected (i.e. the index (index part) 5*a* or another part 5*b* of the scale 5 other than the index 5*a*). The first sensor 6A outputs binary signals (e.g. High and Low) in accordance with the different reflectivities of the index part 5*a* and the other part 5*b*.

Accordingly, as the intermediary transfer belt 10 is rotated, the first sensor 6A continues to output a High signal or a Low signal depending on whether the part of the scale 5 passing through the detection area of the first sensor 6A is an index part 5*a* or the other part 5*b*. By obtaining the time T running from the timing where the output signal changes from Low to High to the next timing where the output signal changes from Low to High (See FIG. 5), the rotating velocity of the surface of the intermediary transfer belt 10 (belt velocity) can be obtained.

It is to be noted that this is merely an example of a method of detecting the belt velocity of the intermediary transfer belt 10. That is, there is no particular limit regarding the type of sensor or scale to be used nor is there a particular limit regarding the method for detecting (calculating) the velocity as long as the velocity of belt can be calculated.

As described above, since the second sensor 6B may have substantially the same configuration as the first sensor 6A, the second sensor 6B may read the indexes 8*a* of the scale 8 on the rotary disk 81 in the same manner as the first sensor 6A. Thereby, the second sensor 6B may calculate the velocity of the intermediary transfer belt 10.

In the belt driving apparatus according to an embodiment of the present invention, the detection signals output from the second sensor 6B are used for controlling (feedback controlling) the belt driving motor 7 during a period beginning at the activation of the belt driving motor 7 and ending when a predetermined time has elapsed from the activation of the belt driving motor 7, and the detection signals output from the first sensor 6A are used for controlling (feedback controlling) the belt driving motor 7 after the predetermined time has elapsed from the activation of the belt driving motor 7. A sensor switching part for selectively switching the above-described signals output from the first and second sensors 6A, 6B may be installed, for example, in the motor controlling apparatus 70.

The image forming apparatus (e.g. color copier) 2000 shown in FIG. 2 has a copier main body 1 mounted on a sheet feeding table 2. A scanner 3 is attached onto the copier main body 1. An automatic document feeder (ADF) 4 is attached onto the scanner 3.

A transfer apparatus 20 is provided inside the copier main body 1. The transfer apparatus 20 has the intermediary transfer belt (in this embodiment, an endless type intermediary transfer belt) 10 disposed substantially in a middle section thereof. The intermediary transfer belt 10 is wound around the driving roller 9 and two driven rollers 15, 16 and is rotatable in a clockwise CW direction. Furthermore, a cleaning apparatus 17 is provided at the left side of the driven roller 15 (See FIG. 2) for removing residual toner remaining on the surface of the intermediary transfer belt 10 after an image transferring process. Furthermore, four photoconductors 40 are provided above the straight area of the intermediary transfer belt 10 between the driving roller 9 and the driven roller 15. Each of the photoconductors 40 is configured to rotate in a counter-clockwise direction along with the rotary movement of the intermediary transfer belt 10. Thereby, the images (toner images) formed on respective photoconductors 40 are successively transferred onto the surface of the intermediary transfer belt 10 in a superposed manner.

A charger 60, a developer 61, a first transfer apparatus 62, a photoconductor cleaning apparatus 63, and a charge removing apparatus 64 are provided surrounding each of the photoconductors 40. Furthermore, an exposing apparatus 21 is provided above the photoconductors 40.

Moreover, a second transfer apparatus 22 is provided below the intermediary transfer belt 10. The second transfer apparatus 22 has a transfer part for transferring the image formed on the surface of the intermediary transfer belt 10 to a recording medium (e.g. recording sheet) P. The second transfer apparatus 22 has a second transfer belt (in this embodiment, an endless type belt) 24 that is wound around a pair of rollers 23, 23'. The second transfer belt 24 is arranged in a manner abutting the driven roller 16 via the intermediary transfer belt 10. The second transfer apparatus 22 transfers the toner image of the intermediary transfer belt 10 onto the recording sheet P delivered between the second transfer belt 24 and the intermediary transfer belt 10.

A fixing apparatus 25 is provided downstream of the sheet conveying direction of the second transfer apparatus 22. The fixing apparatus 25 is for fixing the toner image onto the recording sheet P by conveying the recording sheet P between a fixing belt 26 and a pressing roller 27 that are pressed against each other.

It is to be noted that the second transfer apparatus 22 also serves to deliver the recording sheet P to the fixing apparatus 25 after the toner image is transferred to the recording sheet P. The second transfer apparatus 22 may alternatively use a transfer roller rather than a transfer belt. Furthermore, the second transfer apparatus 22 may also employ a non-contact type charger.

A sheet reversing apparatus 28 is provided below the second transfer apparatus 22 for reversing the side of transferring an image to the recording paper P in a case of forming (transferring) images on both sides of the recording paper P.

Next, an operation of performing a color copying process with the image forming apparatus 2000 is described. First, a document is placed on a document base 30 of the automatic document feeder 4. In a case of manually setting the document, the document is placed on a contact glass 32 of the scanner 3 by opening the automatic document feeder 4 (the automatic document feeder 4 is closed after setting the document on the contact glass 32).

Then, in the case where the document is placed on the document base 30 of the automatic document feeder 4, the document is fed to the top face of the contact glass 32 by pressing a start switch (not shown). In the case where the document is placed on the contact glass 32, the scanner 3 is immediately driven by pressing the start switch (not shown), and first and second scanning members 33, 34 included in the scanner 3 begin a scanning operation. In the scanning operation, a light source of the first scanning member 33 emits light in the direction of the document. Then, the light is reflected from the surface of the document light and is directed toward the second scanning member 34. Then, the reflected light is further reflected by a mirror of the second scanning member 34 and is directed to a reading sensor 36 via an imaging lens 35. Thereby, the content of the document is read out by the reading sensor 36.

Furthermore, the pressing of the "start" switch initiates the rotation of the intermediary transfer belt 10. Furthermore, the photoconductors 40 (40Y, 40C, 40M, 40K) start their rotation substantially at the same time as the rotation of the intermediary transfer belt 10 for transferring color images of Yellow (Y), Cyan (C), Magenta (M), and Black (K) formed on the respective photoconductors 40. The images formed on the respective photoconductors 40 are superposed on the intermediary transfer belt 10 as the intermediary transfer belt 10 rotates in the clockwise CW direction.

Meanwhile, the pressing of the "start" switch initiates the rotation of one of the sheet feeding rollers 42 of the sheet feeding stages inside a sheet feeding table 2. A recording sheet P is delivered out from one of the sheet feed cassettes 44 inside a paper bank 43 to a sheet feeding path by being separated (in a case of plural recording sheets P) and conveyed by a separation roller 45.

Then, the recording sheet P is conveyed to another sheet feed path inside the main body 1 of the image forming apparatus 2000. Then, the conveying of the recording sheet P is temporarily stopped upon reaching the resist rollers 49.

In a case where the sheet feeding operation is performed by manual paper feeding, a target recording sheet P is placed on a manual paper feed tray 51 and is delivered into the image forming apparatus 2000 by a sheet feeding roller 50. Then, the recording sheet P is separated by a separating roller 52 (in a case of plural recording sheets P) and is conveyed to a manual paper feed path 53. Then, the conveying of the recording sheet P is temporarily stopped upon reaching the resist rollers 49.

The resist rollers 49 begin to rotate at a precise timing in correspondence with the color image(s) formed on the intermediary transfer belt 10. Then, the temporarily stopped recording sheet P is delivered between the intermediary transfer belt 10 and the second transfer apparatus 22. Then, the color image is transferred onto the recording sheet P by the second transfer apparatus 22.

Then, the second transfer apparatus 22, which also serves as a conveying apparatus, conveys the recording sheet P to the fixing apparatus 25. The fixing apparatus 25 applies heat and pressure to the recording sheet P for fixing the transferred color image onto the recording sheet P. Then, the recording sheet P is guided to a discharge side by a direction switching claw 55 and is ejected onto a sheet discharge tray 57 by discharge rollers 56.

In a case where a double-side copying mode is selected, the direction switching claw 55 directs the recording sheet P to the side of the sheet reversing apparatus 28 after an image is formed on one side of the recording sheet P.

Then, the sheet reversing apparatus 28 sends the recording sheet P back to the image transferring position for forming an image on the other side of the recording sheet P. Then, the recording sheet P is discharged out to the sheet discharge tray 57 by the discharge rollers 56 after the image is formed on the other side of the recording sheet P.

The first sensor 6A shown in FIG. 3 is situated at an edge part in the width direction of the intermediary transfer belt 10. The scale 5 is mounted onto the surface of the intermediary transfer belt 10 in a manner extending across the entire periphery of the intermediary transfer belt 10 (in the rotating direction of the intermediary transfer belt 10). The first sensor 6A generates data (signals) by reading (detecting) the indexes 5*a* of the scale 5. The motor controlling apparatus 70 shown in FIG. 1 calculates the actual velocity of the intermediary transfer belt 10 based on the data (signals) generated by the first sensor 6A. The motor controlling apparatus 70 controls the belt driving motor 7 in accordance with the calculated velocity, so that the velocity of the intermediary transfer belt 10 can be corrected to equal a target velocity (basic velocity).

Next, a driving system of the intermediary transfer belt 10 and a belt velocity detecting system of the intermediary transfer belt 10 are described.

As shown in FIG. 1, the rotating force of the belt driving motor 7 is transmitted via the driving roller 9 to the intermediary transfer belt 10 that is rotatably wrapped around the driving roller 9. The intermediary transfer belt 10 may be formed of, for example, a fluorine type resin material, a polycarbonate resin material, and/or a polyimide resin material. The intermediary transfer belt 10 may be entirely or partly formed of an elastic material for providing an elastic property to the intermediary transfer belt 10.

Although the belt driving motor 7 rotates the intermediary transfer belt 10 in direction CW via the driving roller 9, the rotating force of the belt driving motor 7 may be transmitted directly to the intermediary transfer belt 10. In another example, a gear may be used to transmit the rotating force of the belt driving motor 7 to the intermediary transfer belt 10.

As described above, although FIG. 1 shows only a part of the scale 5 (including the seam part 11 area) provided on the surface of the intermediary transfer belt 10 for the sake of convenience, the scale 5 is mounted onto the surface of the edge part of the intermediary transfer belt 10 in a manner extending across the entire periphery of the intermediary transfer belt 10 (in the rotating direction of the intermediary transfer belt 10). The edge part of the intermediary transfer belt 10 is formed to match the position of the edge of the photoconductor 40. No toner image is formed (transferred) on the edge part of the intermediary transfer belt 10.

Next, a basic feedback control operation for controlling the belt velocity with the motor controlling apparatus 70 is described with reference to FIG. 6.

Figure 6:
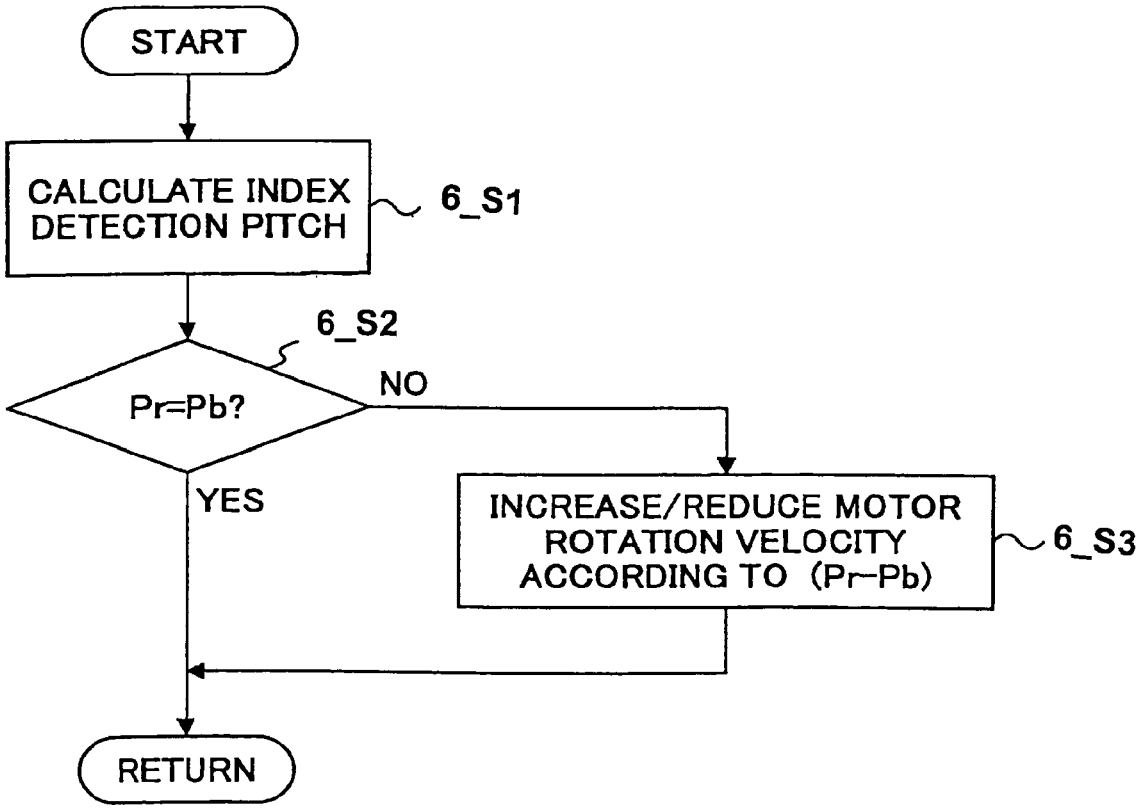
FIG. 6 is a flowchart of a basic feedback control operation for controlling belt velocity with a motor controlling apparatus according to an embodiment of the present invention.

The motor controlling apparatus 70 performs a basic feedback operation to control the belt velocity by executing the steps shown in FIG. 6. First, in Step 6-S1 of the FIG. 6, the motor controlling apparatus 70 calculates an index detection pitch Pr based on the voltage values (output values) output from the first sensor 6A. The calculation of the index detection pitch Pr is performed by obtaining the length of the intervals of the rise points of High signals (High voltage) or the intervals of the drop points of the Low signals (Low voltage) as shown in FIG. 5.

Then, in Step 6-S2, the motor controlling apparatus 70 determines whether obtained index detection pitch Pr is equal to a criterion pitch Pb (in this example, "T" as shown in FIG. 5). In a case where the relationship of Pr=Pb (YES in Step 6-S2) is satisfied, the operation returns to its main routine (not shown) since there is no change in the belt velocity. In a case where the relation of Pr=Pb is not satisfied (NO in Step 6-S2), the belt velocity is controlled for returning to a predetermined velocity (target velocity) since it is determined that there is a change in the belt velocity. Accordingly, in Step 6-S3, the rotary velocity of the belt driving motor 7 is increased or decreased in proportion to the value of (Pr−Pb) so as to control the belt velocity to equal the predetermined velocity (target velocity).

Accordingly, with the image forming apparatus 2000 according to an embodiment of the present invention, belt velocity can be prevented from changing by performing feedback control on the drive speed of the belt driving motor 7 based on the comparison results between the index detection pitch Pr and the criterion pitch Pb.

Furthermore, in a case where the value of (Pr−Pb) is positive (plus), the belt velocity is controlled to equal the predetermined velocity by increasing the rotary velocity of the belt driving motor 7 in proportion to the positive value. On the other hand, in a case where the value of (Pr−Pb) is negative (minus), the belt velocity is controlled to equal the predetermined velocity by reducing the rotary velocity of the belt driving motor 7 in proportion to the negative value.

Accordingly, since changes of belt velocity of the intermediary transfer belt 10 can be prevented by performing feedback control on the speed of the belt driving motor 7, the transferred toner images can be prevented from deviating from each other, for example, in a case of forming color images.

The above-described basic feedback control operation is one example for controlling belt velocity. Other control methods may also be alternatively employed.

Nevertheless, even with the above-described basic feedback control operation, erroneous feedback control may occur in a case where there is an irregular index pitch at a seam 11 between a starting end 11*a* and a terminating end 11*b* of the scale 5 (See FIG. 3). That is, in a case where the portion having an irregular index pitch is detected by the first sensor 6A, the motor controlling apparatus 70 may erroneously determine that the belt velocity has decreased and rapidly (abruptly) increase the belt velocity to a velocity greater than the target velocity. When there is such a rapid change of velocity in the period between activation of the belt driving motor 7 and reaching a target velocity (constant velocity), the belt driving motor 7 may experience various malfunctions (e.g. out of step of the belt driving motor 7, discontinuation of the belt driving motor 7).

In order to prevent such problems from occurring, the image forming apparatus 2000 according to an embodiment of the present invention does not use the output signals from the first sensor 6A during a period beginning at the activation of the belt driving motor 7 and ending when the velocity of the intermediary transfer belt (belt velocity) reaches a target velocity (normal velocity) but rather uses the output signals from the second sensor 6B during such a period. That is, the motor controlling part 70 executes feedback control based on the output signals from the second sensor 6B during such periods so that the belt driving motor 7 can be prevented from being erroneously driven.

Next, a feedback control operation for controlling belt velocity by selectively switching the output signals from two sensors is described with reference to FIG. 7.

Figure 7:
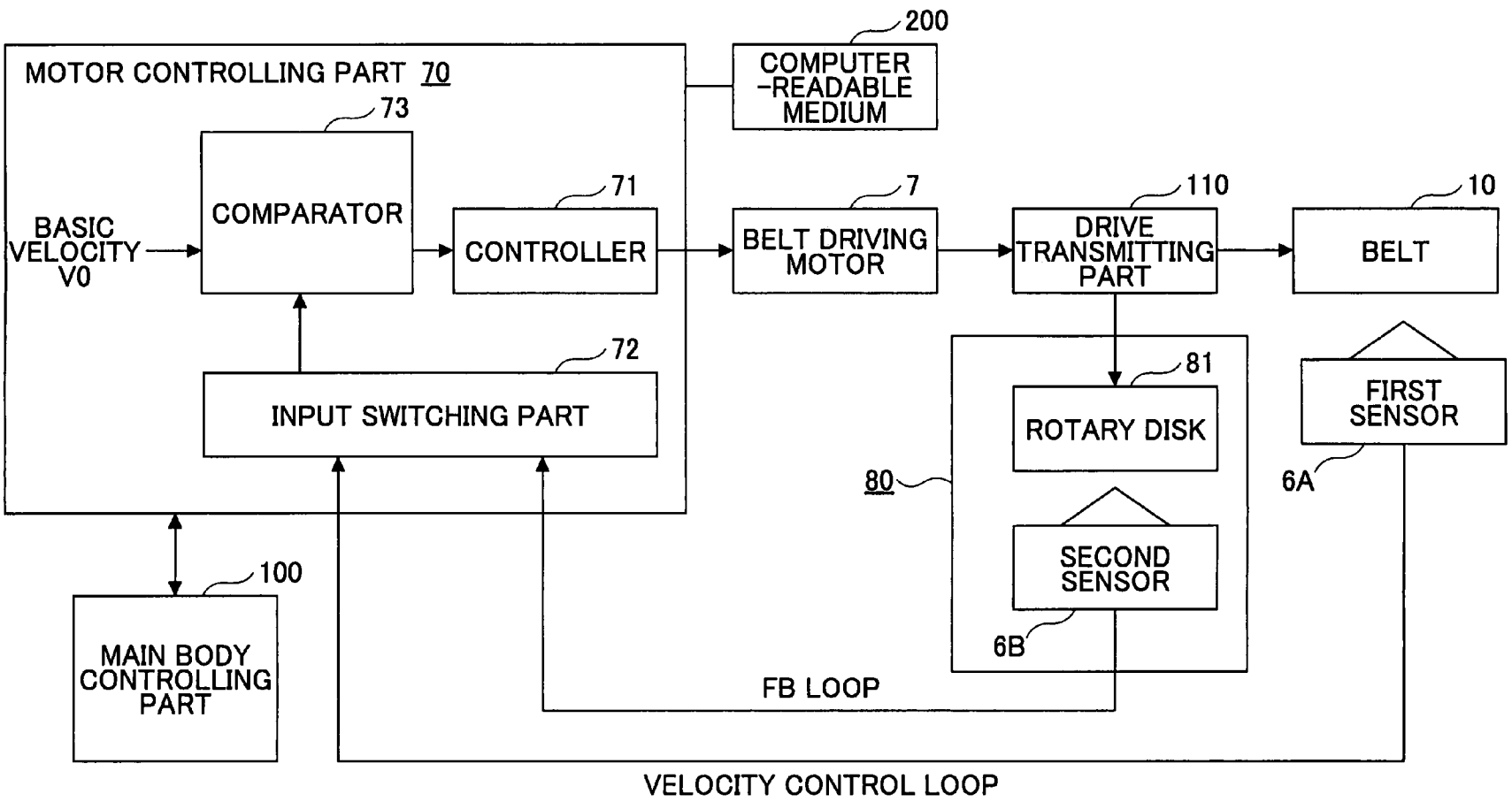
FIG. 7 is a block diagram showing an exemplary configuration of a control system of the belt driving apparatus 1000 included in the image forming apparatus 2000 according to an embodiment of the present invention.

FIG. 7 is a block diagram showing an exemplary configuration of a control system of the belt driving apparatus 1000 included in the image forming apparatus 2000 according to an embodiment of the present invention. The motor controlling part 70 of the belt driving apparatus 1000 includes a controller 70 comprising a central processing unit (CPU) for making various decisions and executing various processes, a ROM for storing various process programs and fixed data, a RAM (including non-volatile RAM) serving as a data memory for storing process data, and an input/output circuit (I/O). The controller 70 is for executing various functions of the belt driving apparatus 1000 such as the functions of a sensor switching part, a time setting part, and a sensor switch canceling part. The motor controlling part 70 is connected to the first sensor 6A, the second sensor 6B, and the belt driving motor 7 for executing the above-described feedback for controlling the belt velocity.

The motor controlling part 70 exchanges information with a main body controlling part 100 that controls the movement of the main body (main body movement) of the image forming apparatus 2000. The information includes, for example, information regarding the main body movement of the image forming apparatus 2000 and information regarding the movement (belt movement) of the belt driving apparatus 1000. The main body controlling part 100 is connected to, for example, a reading sensor 36, an exposing apparatus 21, and an image forming unit 18 for controlling various operations (e.g. the optical reading/writing operation by the reading sensor 36 of the scanner 3, the image forming operation (developing, transferring) of a four color image using the developer 61, the exposing apparatus 21, the first and second transfer apparatuses 62, 22, the intermediary transfer belt 10, etc.).

Reference numeral 110 in FIG. 7 indicates a drive transmitting part for transmitting the driving force (rotary force) of the belt driving motor 7. The drive transmitting part 110 includes, for example, the driving roller 9. Reference numeral 80 in FIG. 7 indicates the encoder. The encoder 80 includes, for example, the rotary disk 81 and the second sensor 6B.

In addition to the controller 70, the motor controlling part 70 also includes, for example, an input switching part 72 for switching the output signals output from the first and second sensors 6A, 6B, and a comparator 73 for comparing the signals corresponding to the basic velocity V0 of the intermediary transfer belt 10 and the signals from the input switching part 72.

Figure 8:
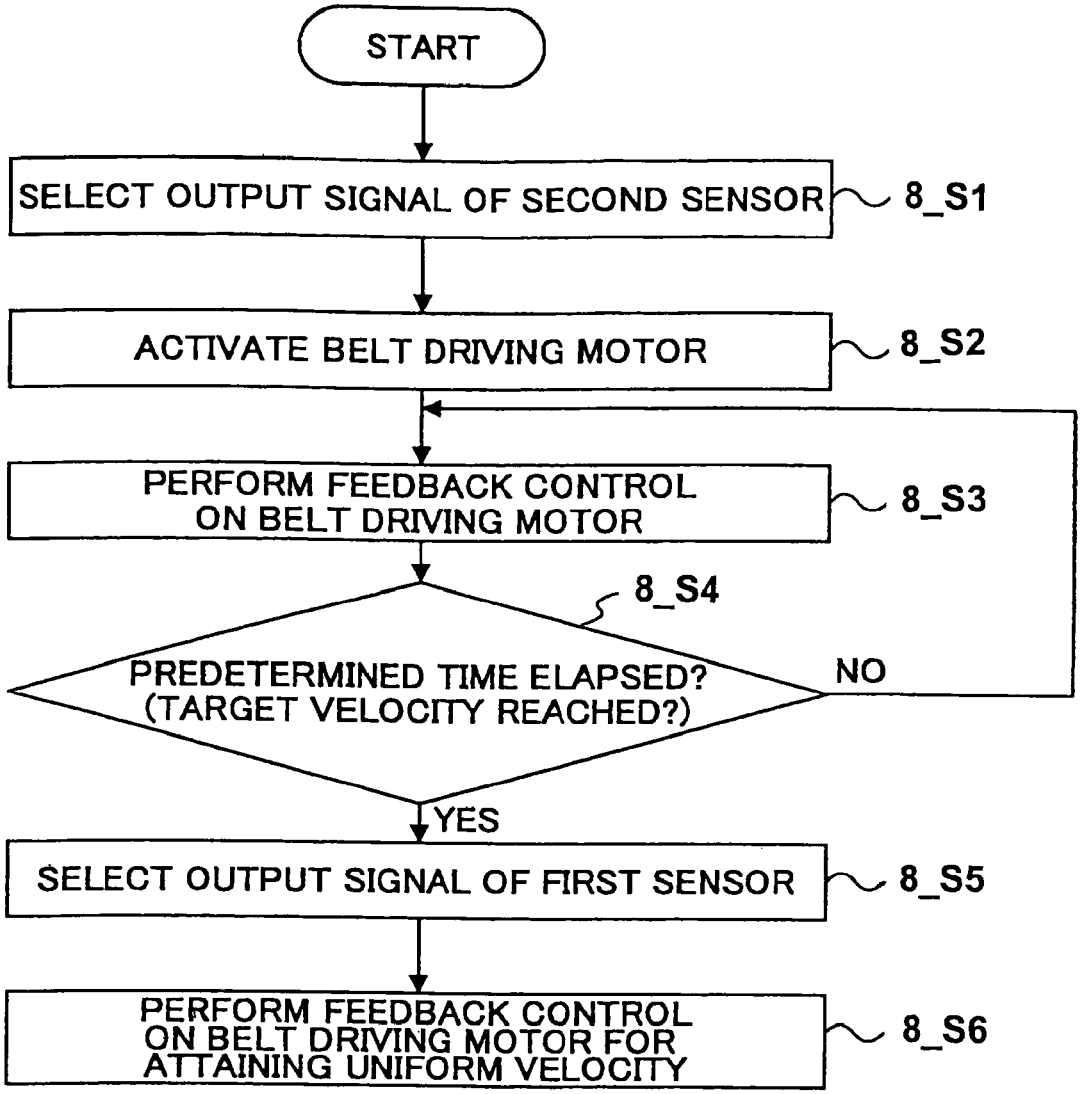
FIG. 8 is a flowchart of a belt driving method according to an embodiment of the present invention.

FIG. 8 is a flowchart of a belt driving method according to an embodiment of the present invention. Next, the belt drive control operation using the control system of the belt driving apparatus 1000 (FIG. 7) is described with reference to FIG. 8.

When the motor controlling part 70 shown in FIG. 7 receives a start signal from the main body controlling part 100, the input switching part 72 selects the signals of the FB loop (i.e. output signals from the second sensor 6B) as the feedback signals to be used (Step 8-S1). Then, the controller 71 activates the belt driving motor 7 (Step 8-S2). Then, the controller 71 performs feedback control on the belt driving motor 7 based on the output signals from the second sensor 6B that reads the indexes 8*a* of the scale 8 of the rotary disk 81 of the encoder 80 (Step 8-S3).

For example, the normal velocity V0, which is the target control velocity, may be set to increase along with the passing of time. The comparator 73 compares the output signals from the second sensor 6B and the signals corresponding to the normal velocity V0 and sends data to the controller 70 according to the comparison. The data sent to the controller 70 show whether the current belt velocity indicated by the output signals of the second sensor 6B is greater than the normal velocity V0. The controller 71 adjusts the electric drive current applied to the belt driving motor 7 in accordance with the data received from the comparator 73, so that the current belt velocity equals the normal belt velocity V0.

After a predetermined time (i.e. sensor switching time) elapses from the activation of the belt driving motor 7 (Yes in Step 8-S4), the controller 71 instructs the input switching part 72 to switch the feedback signals to the signals of the velocity control loop (i.e. output signals from the first sensor 6A). The predetermined time is a time in which the belt velocity is anticipated to reach the target velocity from the activation of the belt driving motor 7. In accordance with the instruction from the controller 71, the input switching part 72 switches the feedback signals (in this example, the output signals from the second sensor 6B) to the output signals from the first sensor 6A (Step 8-S5). Alternatively, in Step 8-S4, the controller 71 may determine whether the current belt velocity has reached the target velocity (i.e. the steady state velocity of the intermediary transfer belt 10) by referring to the value of the normal velocity V0 and the output signals received from the comparator 73, and in Step 8-S5 the input switching part 72 may switch the feedback signals to the output signals from the first signals 6A in response to the determination of the controller 71.

Then, the controller 71 executes feedback control for maintaining the intermediary transfer belt 10 at a uniform velocity, that is, the target velocity V0 (Step 8-S6).

The normal velocity V0, which is the target control velocity, may be set equal to the velocity of the intermediary transfer belt 10 when in a steady state. In this case, the comparator 73 compares the output signals from the first sensor 6A and the signals corresponding to the target velocity V0, and sends data to the controller 71 for showing whether the current velocity indicated by the output signals of the first sensor 6A is greater than the normal velocity V0. The controller 71 adjusts the electric drive current applied to the belt driving motor 7 in accordance with the data received from the comparator 73, so that the current belt velocity equals the target belt velocity V0 (i.e. uniform velocity).

In controlling the intermediary transfer belt 10 to have a uniform velocity (uniform velocity control), the controller 71 may cancel its application of electric drive current to the belt driving motor 7 based on the comparison of the comparator 73 in a case where a seam of the scale 5 is detected from the output signals of the first sensor 6A. In another example where a seam of the scale 5 is detected, alternative signals (dummy signals) stored in the memory (e.g. non-volatile RAM) of the controller 71 may be used instead of using the output signals of the first sensor S1. In yet another example where a seam of the scale 5 is detected, other alternative methods may also be employed for controlling the belt driving motor 7 (e.g. Japanese Laid-Open Patent Application No. 2003-140376).

In addition to the load applied to the belt driving motor 7 for driving the drive transmitting part 110 and the intermediary transfer belt 10, the belt driving motor 7 is also applied with a load for the second transfer roller 23 that contacts the second transfer apparatus 22. Furthermore, the second transfer roller 23 may alternatively be driven by a second transfer motor (not shown). In such a case, since the drive source for the intermediary transfer belt 10 and the drive source for the second transfer roller 23 are different, the second transfer roller 23 may create an abrasion on the surface of the intermediary transfer belt 10. In order to prevent this problem, the belt driving motor 7 may be controlled in correspondence with the rise of the second transfer roller 23. In this case, the sensor switching time is the time required for raising the speed of the second transfer roller 23 (rising time). Accordingly, by presetting the rising time of the second transfer roller 23 as the sensor switching time according to the instructions from the main body controlling part 100, the motor controlling part 70 can prevent damaging the surface of the intermediary transfer belt 10 by the abrasive contact with the second transfer roller 23.

As described above, the motor controlling part 70 executes feedback control on the belt driving motor 7 by using the output signals of the second sensor 6B during the period starting at the activation of the belt driving motor 7 and ending when the sensor switching time elapses, and using the output signals of the first sensor 6A after the sensor switching time elapses. In controlling the belt driving motor 7 by executing feedback control, the motor controlling part 70 may continue to use the output signals of the second sensor 6B and not switch using the output signals of the first sensor 6A, for example, in a case where the motor controlling part 70 determines that there are no output signals of the first sensor 6A or that the waveform of the output signals of the first sensor 6A is irregular. However, in a case where the output signals of the second sensor 6B continue to be used as feedback signals after the sensor switching time elapses, it is preferred for the feedback control signals to be switched to the output signals of the first sensor 6A before the operation of writing images onto the photoconductors 40 (image forming operation). This is due to the fact that switching feedback signals during the image forming operation may cause slight changes in the velocity of the intermediary transfer belt 10 and cause the velocity of the photoconductors 40 to change. As a result, the position at which an image is expected to be written onto respective photoconductors 40Y, 40M, 40C, 40K may slightly deviate, to thereby create deviated color images.

Figure 9:
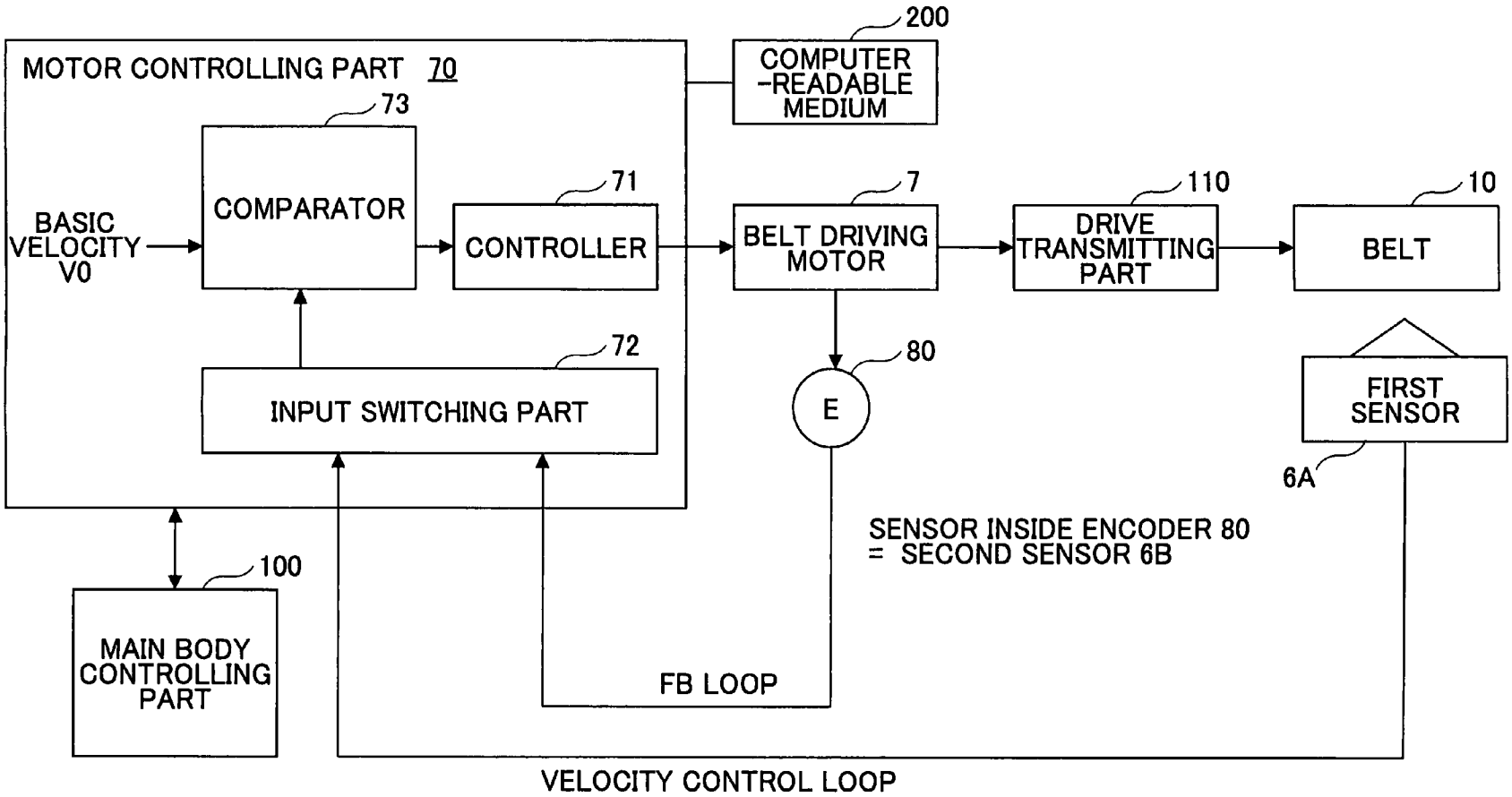
FIG. 9 is a block diagram showing an exemplary configuration of another control system of the belt driving apparatus 1000 included in the image forming apparatus 2000 according to another embodiment of the present invention.
Figure 10:
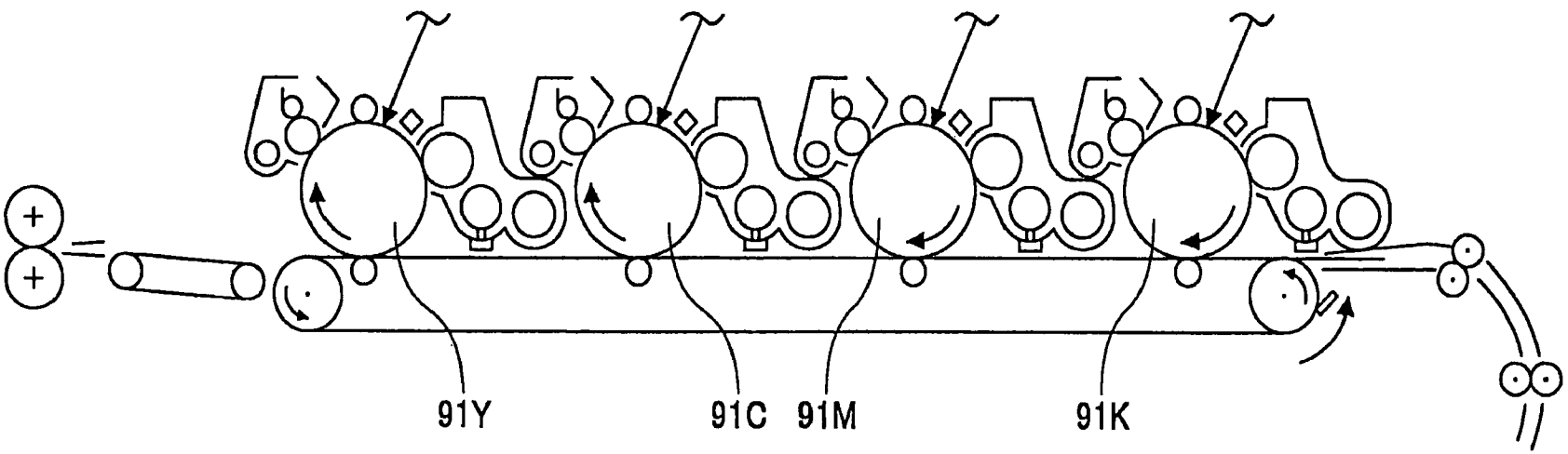
FIG. 10 is a schematic diagram showing an image forming part of a conventional image forming apparatus (direct transfer type)
Figure 11:
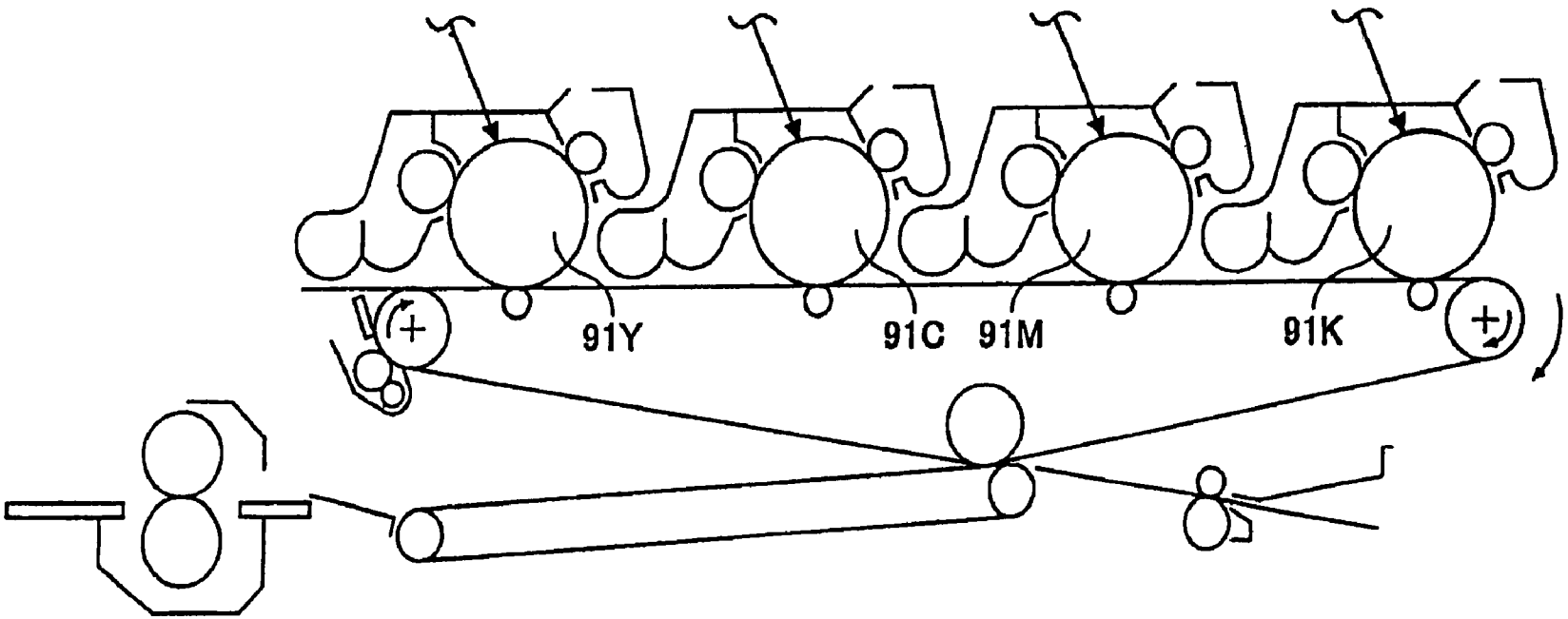
FIG. 11 is a schematic diagram showing an image forming part of another conventional image forming apparatus (intermediary transfer type)
Figure 12:
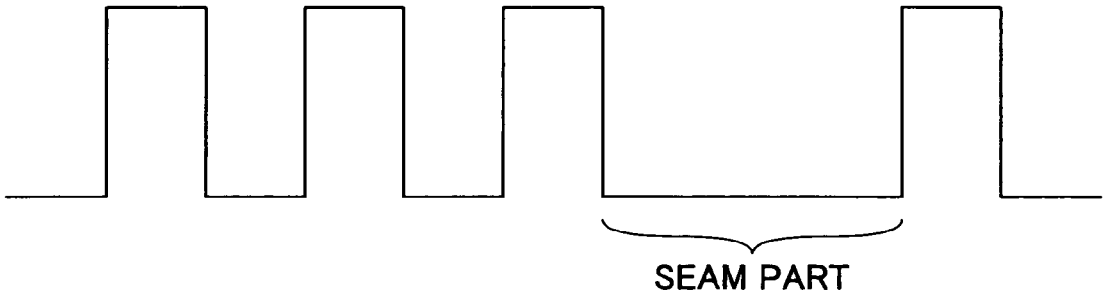
FIG. 12 is a schematic diagram showing a waveform of detection pulses (output signals) in a case where a sensor detects a seam of a belt and indexes in the vicinity of the seam.
Figure 13:
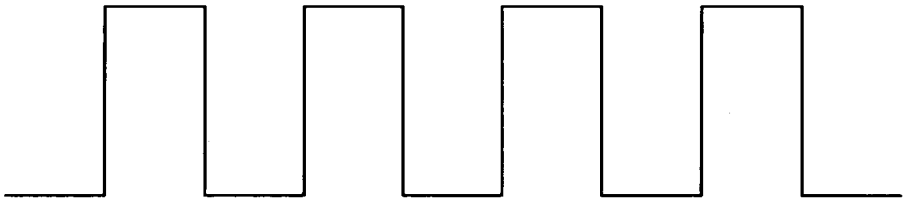
FIG. 13 is a schematic diagram showing a waveform of detection pulses (output signals) in a case where a sensor detects areas other than the seam of the belt.

FIG. 9 is a block diagram showing an exemplary configuration of another control system of the belt driving apparatus 1000 included in the image forming apparatus 2000 according to another embodiment of the present invention. In FIG. 9, like components are denoted by like reference numerals as of the FIG. 7. In FIG. 9, the rotary disk 81 and the second sensor 6B are not illustrated for the sake of convenience.

In this embodiment, the encoder 80 is attached to the rotary axle of the belt driving motor 7. Accordingly, the second sensor 6B reads the indexes 8*a* of the scale 8 of a disk 80 provided inside the encoder 81. The motor controlling part 70 executes feedback control during the rising (increasing the speed) of the belt driving motor 7 in accordance with the output signals of the second sensor 6B.

In the embodiment shown in FIG. 7, the indexes of the rotary disk 81 provided inside the encoder 80 attached to the rotary axle of the driving roller 9 serve as the detection target of the second sensor 6B. In the embodiment shown in FIG. 9, the indexes of the rotary disk 81 provided inside the encoder 80 attached to the rotary axle of the belt driving motor 7 are described. Nevertheless, the encoder 7 may also be attached to the rotary axles of other components which cooperatively move with the drive (rotation) of the intermediary transfer belt 10. For example, the encoder 80 may be attached to the rotary axle of the driven roller 15 or 16 which is rotated by the rotation of the intermediary transfer belt 10. Thereby, the rise of the belt driving motor 7 may be controlled in accordance with the output signals of the second sensor 6B that reads the indexes 8*a* of the scale 8 formed on the rotary disk 81 inside the encoder 80.

In another example, a belt driving motor 7 having the function(s) of the encoder 80 may alternatively be used.

Furthermore, although the velocity of the intermediary transfer belt 10 is controlled in this embodiment, the position of the intermediary transfer belt 10 may alternatively be controlled.

Furthermore, the above-described functions executed by the controller 71, the input/output switching part 72, and the comparator 73 may be executed by a program that is stored, for example, in a ROM of the CPU (computer) of the controller 71. Accordingly, the program causes the CPU inside the controller 71 to execute the functions of a sensor switching part, a predetermined time setting part, and a switch restricting part.

The program may alternatively be recorded in various computer-readable media or recording media 200 such as a CD-ROM or a flexible disk. Furthermore, the program may also be stored in a non-volatile memory such as a SRAM, EEPROM, or a memory card. Accordingly, the program stored in the media or the memory can be executed, for example, through the CPU (computer) in the controller 71 for executing the above-described processes for executing feedback control of the belt driving motor 7.

The program may be executed via a network by an outside device having the program stored in its memory or recording medium or may be downloaded from the outside device.

Although the present invention is described using an example of a image forming apparatus having a belt driving part for controlling the rotation of an intermediary transfer belt, the belt of the present invention is not be limited to an intermediary transfer belt, and the image forming apparatus of the present invention is not to be limited to a color copier. For example, the belt of the present invention may be a photoconductor belt, a transferring belt, a transferring/conveying belt, and/or an image recording medium conveying belt. For example, the image forming apparatus may also be a color printer.

In other words, as long as the image forming apparatus of the present invention includes a belt driving part that drives (rotates) an endless belt that is wrapped around plural rollers by using one or more of the plural rollers, the type of belt or the type of image forming apparatus is not to be limited.

Further, the present invention is not limited to these embodiments, but variations and modifications may be made without departing from the scope of the present invention.

The present application is based on Japanese Priority Application Nos. 2005-156227 and 2006-128559 filed on May 27, 2005 and May 2, 2006, with the Japanese Patent Office, the entire contents of which are hereby incorporated by reference.

The invention claimed is:

1. A belt driving apparatus using feedback signals for executing feedback control of a motor that drives a rotation of a belt, the belt driving apparatus comprising:

a first sensor for detecting an index of a scale formed along a peripheral direction of the belt;

a second sensor for detecting a detection target cooperatively moving with the rotation of the belt;

and a sensor switching part for selectively switching the feedback signals used for executing the feedback control of the motor, the feedback signals including first signals output from the first sensor and second signals output from the second sensor;

wherein the sensor switching part selects the second signals as the feedback signals to be used during a period beginning at an activation of the motor and ending when a condition is satisfied, wherein the sensor switching part selects the first signals as the feedback signals to be used after the condition is satisfied with an exception that the use of the second signals as the feedback signals is continued even after the condition is satisfied without switching to use the first signals when a waveform of the first signals is irregular.

2. The belt driving apparatus as claimed in claim 1, wherein the sensor switching part switches the use of the feedback signals from the second signals to the first signals when a time elapses.

3. The belt driving apparatus as claimed in claim 2, wherein the time is a time required for a rotational velocity of the belt to reach a target velocity.

4. The belt driving apparatus as claimed in claim 3, wherein the sensor switching part switches the feedback signals being used from the second signals to the first signals when the sensor switching part detects that the rotational velocity of the belt has reached the target velocity.

5. The belt driving apparatus as claimed in claim 2, wherein the time is set in accordance with a load applied to the motor.

6. The belt driving apparatus as claimed in claim 1, wherein the motor includes a rotary axle to which an encoder is attached, wherein the encoder includes a disk, and wherein the detection target is an index formed on the disk.

7. The belt driving apparatus as claimed in claim 1, further comprising a driving roller that rotates the belt, wherein the driving roller includes a rotary axle to which an encoder is attached, wherein the encoder includes a disk, and wherein the detection target is an index formed on the disk.

8. The belt driving apparatus as claimed in claim 1, further comprising a driven roller that is rotatively driven by the rotation of the belt, wherein the driven roller includes a rotary axle to which an encoder is attached, wherein the encoder includes a disk, and wherein the detection target is an index formed on the disk.

9. The belt driving apparatus as claimed in claim 1, wherein the second signals are used as the feedback signals even after the condition is satisfied when the first signals are abnormal.

10. An image forming apparatus comprising:

a motor for driving a rotation of a belt;

a controller for executing feedback control of the motor by using feedback signals;

a first sensor for detecting an index of a scale formed along a peripheral direction of the belt;

a second sensor for detecting a detection target cooperatively moving with the rotation of the belt; and a sensor switching part for selectively switching the feedback signals used for executing the feedback control of the motor, the feedback signals including first signals output from the first sensor and second signals output from the second sensor;

wherein the sensor switching part selects the second signals as the feedback signals to be used during a period beginning at an activation of the motor and ending when a condition is satisfied, wherein the sensor switching part selects the first signals as the feedback signals to be used after the condition is satisfied with an exception that the use of the second signals as the feedback signals is continued even after the condition is satisfied without switching to use the first signals when a waveform of the first signals is irregular.

11. The image forming apparatus as claimed in claim 10, wherein the sensor switching part switches the feedback signals being used from the second signals to the first signals when a time elapses.

12. The image forming apparatus as claimed in claim 11, wherein the time is a time required for a rotational velocity of the belt to reach a target velocity.

13. The image forming apparatus as claimed in claim 12, wherein the sensor switching part switches the feedback signals being used from the second signals to the first signals when the sensor switching part detects that the rotational velocity of the belt has reached the target velocity.

14. The image forming apparatus as claimed in claim 11, wherein the time is a time within a period starting at the activation of the motor and ending when an image forming operation begins.

15. The image forming apparatus as claimed in claim 10, wherein the belt includes one or more of a photoconductor belt, a transfer belt, an intermediary transfer belt, and an image recording medium conveying belt.

16. A belt driving method for executing feedback control of a motor that drives a rotation of a belt, the method comprising:

executing the feedback control according to first signals output from a first sensor that detects an index of a scale formed along a peripheral direction of the belt after a condition is satisfied;

executing the feedback control according to second signals output from a second sensor that detects a detection target cooperatively moving with the rotation of the belt during a period beginning at an activation of the motor and ending when the condition is satisfied with an exception that the use of the second signals as the feedback signals is continued even after the condition is satisfied without switching to use the first signals when a waveform of the first signals is irregular.

17. A computer-readable medium on which a program is recorded for causing a computer to execute a belt driving method for executing feedback control of a motor that drives a rotation of a belt, the belt driving method comprising:

executing the feedback control according to first signals output from a first sensor that detects an index of a scale formed along a peripheral direction of the belt after a predetermined condition is satisfied;

executing the feedback control according to second signals output from a second sensor that detects a detection target cooperatively moving with the rotation of the belt during a period beginning at an activation of the motor and ending when the predetermined condition is satisfied with an exception that the use of the second signals as the feedback signals is continued even after the condition is satisfied without switching to use the first signals when a waveform of the first signals is irregular.

* * * * *